US008596903B2

(12) United States Patent
Hur

(10) Patent No.: US 8,596,903 B2
(45) Date of Patent: Dec. 3, 2013

(54) METHOD FOR ABSORBING A VEHICLE IMPACT USING KINETIC FRICTION FORCE AND ROLLING FORCE PRODUCED BY THE DRAGGING OF A SURFACE OF ROLLED TUBE, AND VEHICLE IMPACT ABSORBING APPARATUS USING SAME

(75) Inventor: Kwang Yong Hur, Chungcheongbuk-do (KR)

(73) Assignee: Impact Blackhole Co., Ltd., Chungcheongbuk-do (KR)

( * ) Notice: Subject to any disclaimer, the term of this patent is extended or adjusted under 35 U.S.C. 154(b) by 0 days.

(21) Appl. No.: 13/375,421

(22) PCT Filed: May 24, 2010

(86) PCT No.: PCT/KR2010/003235

§ 371 (c)(1),
(2), (4) Date: Jan. 9, 2012

(87) PCT Pub. No.: WO2010/143826

PCT Pub. Date: Dec. 16, 2010

(65) Prior Publication Data

US 2012/0104337 A1 May 3, 2012

(30) Foreign Application Priority Data

Jun. 9, 2009 (KR) ..... 10-2009-0050777
Jan. 4, 2010 (KR) ..... 10-2010-0000195
Mar. 20, 2010 (KR) ..... 10-2010-0024972

(51) Int. Cl.
*E01F 15/00* (2006.01)

(52) U.S. Cl.
USPC ..... 404/6; 256/13.1

(58) Field of Classification Search
CPC ..... E01F 15/14; E01F 15/146; E01F 15/148
USPC ..... 256/13.1; 404/6, 10
See application file for complete search history.

(56) References Cited

U.S. PATENT DOCUMENTS 4,352,484 A 10/1982 Gertz et al.
5,597,055 A * 1/1997 Han et al. ..... 188/371

(Continued)

FOREIGN PATENT DOCUMENTS

JP 09-189014 7/1997
JP 10-114920 5/1998

(Continued)

OTHER PUBLICATIONS

International Search Report (Form PCT/ISA/210) for corresponding International Application No. PCT/KR2010/003235.
Written Opinion (Form PCT/ISA/237) for corresponding International Application No. PCT/KR2010/003235.

*Primary Examiner* — Joshua Kennedy
(74) *Attorney, Agent, or Firm* — Merchant & Gould P.C.

(57) ABSTRACT

A method for absorbing vehicle's impact includes primarily absorbing impact energy of the vehicle by dragging action of a front barrier and a first dragging kinetic frictional rolling force inducing member that are sequentially inserted and installed in a front end portion of a rolled tube made of a soft material, so that a maximum deceleration of the vehicle slows to 20 g or less. The method further includes dragging a second dragging kinetic frictional rolling force inducing member having a kinetic friction coefficient larger than that of the first dragging kinetic frictional rolling force inducing member and installed at an intermediate portion of the rolled tube to secondarily absorb and reduce kinetic energy. The method further includes drag a rear barrier and a third dragging kinetic frictional rolling force inducing member that are installed along a stopper distance, so that a kinetic frictional force of the vehicle becomes a maximum stop frictional force in a state in which kinetic friction coefficients of the first dragging kinetic frictional rolling force inducing member and the second and third dragging kinetic frictional rolling force inducing members and are added.

12 Claims, 19 Drawing Sheets

(56) References Cited

U.S. PATENT DOCUMENTS

| | | | | |
|---|---|---|---|---|
| 5,868,521 | A * | 2/1999 | Oberth et al. | 404/6 |
| 6,848,334 | B2 * | 2/2005 | Kluemper et al. | 74/492 |
| 7,758,277 | B2 * | 7/2010 | La Turner et al. | 404/6 |
| 8,016,513 | B2 * | 9/2011 | Shin | 404/6 |
| 8,074,761 | B2 * | 12/2011 | LaTurner et al. | 180/274 |
| 8,388,259 | B2 * | 3/2013 | Amengual Pericas | 404/6 |
| 2002/0122692 | A1 | 9/2002 | Stephens et al. | |
| 2003/0210954 | A1 | 11/2003 | Kang | |
| 2010/0080652 | A1 * | 4/2010 | Shin | 404/6 |
| 2012/0207542 | A1 * | 8/2012 | Amengual Pericas | 404/6 |

FOREIGN PATENT DOCUMENTS

| | | |
|---|---|---|
| JP | 2000-170130 | 6/2000 |
| JP | 2001-200513 | 7/2001 |
| JP | 2002-227151 | 8/2002 |
| JP | 2003-064629 | 3/2003 |
| JP | 2005-525487 | 8/2005 |
| KR | 20-0412263 | 3/2006 |
| KR | 10-2005-0120485 | 6/2006 |
| KR | 10-0707914 | 4/2007 |

* cited by examiner

Configuration of vehicle in ground

Case where a head collides against a left wall

Relationship of PHD to time (sec)

METHOD FOR ABSORBING A VEHICLE IMPACT USING KINETIC FRICTION FORCE AND ROLLING FORCE PRODUCED BY THE DRAGGING OF A SURFACE OF ROLLED TUBE, AND VEHICLE IMPACT ABSORBING APPARATUS USING SAME

This application is a National Stage Application of PCT/KR2010/003235, filed 24 May 2010, which claims benefit of Ser. No. 10-2010-0024972, filed 20 Mar. 2010 in South Korea, and which also claims benefit of Ser. No. 10-2010-0000195, filed 4 Jan. 2010 in South Korea, and which also which claims benefit of Ser. No. 10-2009-0050777, filed 9 Jun. 2009 in South Korea and which applications are incorporated herein by reference. To the extent appropriate, a claim of priority is made to each of the above disclosed applications.

BACKGROUND

The present invention relates to a method for absorbing vehicle impact using a kinetic frictional force and a rolling force produced by dragging a surface of a rolled tube, and an apparatus for absorbing the vehicle impact using the same, and more particularly, to an impact absorbing method and apparatus which can absorb kinetic energy of a vehicle using a kinetic frictional force by dragging a surface of a rolled tube made of a soft material with a kinetic friction inducing bolt, which is made of a hard material, of a dragging kinetic frictional rolling force inducing member, in which the maximum deceleration is maintained slowly to 20 g or less. The reason is that the maximum deceleration is fatal to a passenger's life.

Since the maximum deceleration is maintained slowly by the kinetic friction and the rolling force, the present invention is a new impact absorbing manner absolutely different from a conventional impact absorbing manner using bending. In particular, from a point of view in that the rolling tube made of the soft material and the kinetic friction inducing bolt, which is made of a hard material, of the dragging kinetic frictional rolling force inducing member cooperate with each other to produce the kinetic friction force and the rolling force, and in that a rear barrier is moved along a stopper distance of the kinetic frictional force inducing member and the guard rail, as compared with the conventional impact absorbing manner in which the rear barrier is fixed, the present invention is a new impact absorbing manner absolutely different from the conventional impact absorbing manner.

The vehicle impact absorbing apparatus according to the present invention is installed to the entrance of overpasses or the front portion of support piers. Of course, such an impact absorbing apparatus can be applied to a guard rail for a road side of general roads or highways.

RELATED ART

Impact absorbing facilities installed on roads are facilities for saving human lives by establishing a displacement continuously to slowly maintain the maximum deceleration applied to a vehicle and passengers, while absorbing dynamic kinetic energy of the vehicle.

In general, the impact absorption of the impact absorbing facility utilizes a mechanism capable of absorbing the impact when a velocity (Vo) of the vehicle before collision becomes zero ($V_1$) after it collides against the impact absorbing facility.

The deceleration is a variation ($\Delta V=V_1-Vo$) of the velocity to a time ($\Delta t$) taken when the impact instant velocity (Vo) of the vehicle becomes zero ($V_1=0$) after collision. If it is represented by an equation, the deceleration=$\Delta V/\Delta t$.

Since $V_1=0$ after collision, the deceleration is increased as the impact instant velocity Vo is high and the time ($\Delta t$) is short. A displacement to the impact amount is short as the time ($\Delta t$) taken when the impact instant velocity (Vo) of the vehicle becomes zero ($V_1=0$) after collision is short. The reason is that the displacement is a physical quantity defined by a product of a velocity and a time.

If the maximum deceleration applied to the vehicle and the passengers excesses a reference value, it is fatal to a passenger's life. The reason is that a head of the passenger collides against an inner wall of the vehicle at the maximum deceleration.

Evaluation on the passenger's safety due to the maximum deceleration is achieved by THIV (Theoretical Head Impact Velocity) and PHD (Post-impact Head Deceleration). The THIV and the PHD are indexes to evaluate the impact risk of a passenger when the vehicle collides against the safety facility.

The passenger safety index is shown in Table 1.

TABLE 1

| Passenger Safety Index<br>Passenger Safety Index | |
|---|---|
| Longitudinal velocity Vx; THIV ≤ 44 km/hr<br>Transverse velocity: Vy; THIV ≤ 33 km/hr | PHD ≤ 20 g<br>(g = 9.8 m/sec*) |

For the safe of passengers, the impact absorbing facility should meet the conditions of the THIV and the PHD in Table 1.

THIV (Theoretical Head Impact Velocity)

FIG. 18 shows a relationship between a deceleration of a vehicle and a relative velocity (Vo) of a passenger's head. Since the vehicle undergoes translation at the moment that it collides against the safety facility, the vehicle and the passenger's head have a constant velocity Vo on the same plane.

C is a center point of the vehicle.

Cxy is a vehicle coordinate system, in which x indicates a transverse direction, and y indicates a longitudinal direction.

In this instance, a flight distance of a passenger's head is shown in FIG. 19.

The surface, against which the passenger's head collides, is regarded to vertical to an xy plane. As shown in FIG. 19, the flight distance of the passenger's head from an initial position to a collision surface is a longitudinal Dx and a transverse Dy. A reference value is Dx=0.6 m and Dy=0.3 m. A flight time of the head is a time when the head collides against any one of three imaginary collision surfaces, as shown in FIG. 19.

PHD (Post-Impact Head Deceleration)

FIG. 20 is a graph illustrating a deceleration of the passenger's head to a time after the head collides against the safety facility.

According to the graph, the maximum deceleration occurs at the initial collision, and its value is approximately PHD=25 g (g=9.8 m/s$^2$). It will be understood that the deceleration index PHD of the passenger's head becomes PHD=0 with the lapse of time. PHD=25 g is a value exceeding the passenger safety index PHD=20 g shown in Table 1. Accordingly, the safety facility shown in FIG. 20 is dangerous for the passenger's life.

The safety index PHD of the passenger is an evaluation index to the deceleration, and the safety index THIV of the passenger is an evaluation index to the velocity. The deceleration is a variation (=ΔV/Δt) of the velocity to the time, and thus PHD and THIV are the same relationship as the deceleration and the velocity.

Problems contained in the impact absorbing manner in the related art will now be described.

The impact absorbing manner will be classified into a bending deformation manner and a reaction manner.

The bending deformation manner has an advantage in that since the impact absorbing apparatus is collapsed to absorb the impact, the displacement gets longer, so that the safety index of the passenger to the maximum deceleration meets the condition of PHD=20 g. However, it is not possible to reuse the impact absorbing apparatus in the state in which the impact is applied thereto.

The impact absorbing manner disclosed in Korean Patent Registration No. 0765954, assigned to the applicant, is a bending deformation manner in which the impact absorbing apparatus is collapsed to absorb the impact.

Even though the impact absorbing apparatus disclosed in Korean Patent Registration No. 0765954 includes a number of x-shaped unit absorbing members and can effectively absorb the kinetic energy without significantly increasing the deceleration of the vehicle, it has a problem in that since the x-shaped impact damping apparatus is deformed and collapsed to absorb the kinetic energy, it is not possible to reuse it if it is collapsed by the impact. In addition, there is a concern about secondary accident due to the remaining kinetic energy since the rear end is not provided with a stopper distance (S).

The reaction manner is a manner of absorbing the impact by a compressive force of a spring. Since the displacement is limited, the displacement is shorter than the bending deformation manner, so that the maximum deceleration is high. Therefore, there is a concern that the passenger safety index PHD may exceed a reference value. In addition, the compressed spring applies a repulsive force to the vehicle in a direction opposite to a rush direction of the vehicle in the state in which it absorbs the impact energy intact. There is a problem in that it converts the rush direction of the vehicle to the opposite direction, so that it causes the secondary accident in the passenger which is fatal to the safety of the passenger.

Meanwhile, dislike the above manner, a kinetic friction manner can be conceived as a manner of absorbing the kinetic energy. If a force (external force) is applied to a stationary object, the object is about to move. The frictional force immediately before being about to move is referred to as the maximum stationary frictional force. A frictional force of the object which overcomes the maximum stationary frictional force and starts to move is referred to as the kinetic frictional force. The kinetic frictional force is less than the maximum stationary frictional force. Since the kinetic friction is determined by a vertical force (N) of the object and a kinetic frictional coefficient (μ'), like the stationary friction, it is not related to the velocity of the object.

SUMMARY

Therefore, the present invention has been made to solve the above-mentioned problems occurring in the related art, and an object of the present invention is to continuously secure a displacement while dynamic kinetic energy of a vehicle is absorbed by a kinetic frictional force and rolling force produced by dragging a surface of a soft rolled tube, and to let an evaluation index of PHD belong to a passenger safety index by slowly maintaining the maximum deceleration applied to the vehicle and passenger, thereby preventing a human in safe against fatal impact.

Another object of the present invention is to reduce the maximum deceleration by 20 g or less by a kinetic frictional force of a first dragging kinetic frictional force inducing member at a front end portion of a rolled tube, in which dynamic kinetic energy of a vehicle is the highest, significantly reduce the kinetic energy by a second dragging kinetic frictional rolling force inducing member having a kinetic friction coefficient larger than that of the first dragging kinetic frictional force inducing member at an intermediate portion of the rolled tube, and to wholly absorb the remaining kinetic energy by a third dragging kinetic frictional rolling force inducing member installed along a stopper distance.

Still another object of the present invention is to recycle an impact absorbing apparatus, as well as a damaged rolled tube, by pressing, deforming and sliding a surface and corner of the rolled tube with a first dragging kinetic frictional force inducing member and second and third dragging kinetic frictional rolling force inducing members which are inserted along a displacement and a stopper distance of the rolled tube.

The present invention relates to a method for absorbing vehicle impact using a kinetic frictional force and a rolling force produced by dragging a surface of a rolled tube, and an apparatus for absorbing the vehicle impact using the same.

First, the method for absorbing the impact of the vehicle by using the kinetic frictional force produced by dragging the surface of the rolled tube will be described in detail.

In order to accomplish the above-mentioned objects, there is provided a method for absorbing vehicle's impact using a kinetic frictional force produced by dragging a surface of rolled tube 20, wherein impact energy of the vehicle is primarily absorbed by dragging action of a front barrier 50*a* and a first dragging kinetic frictional rolling force inducing member 40*a* which are sequentially inserted and installed in a front end portion of a rolled tube 20 made of a soft material, so that a maximum deceleration of the vehicle slows to 20 g or less; the front barrier 50*a* and the first dragging kinetic frictional rolling force inducing member 40*a* which are subject to the dragging action roll and drag a second dragging kinetic frictional rolling force inducing member 40*b* having a kinetic friction coefficient larger than that of the first dragging kinetic frictional rolling force inducing member 40*a* and installed at an intermediate portion of the rolled tube 10 to secondarily absorb and reduce kinetic energy; and the front barrier 50*a*, the first dragging kinetic frictional rolling force inducing member 40*a* and the second dragging kinetic frictional rolling force inducing member 40*b* which are still subject to the dragging action roll and drag a rear barrier 50*c* and a third dragging kinetic frictional rolling force inducing member 40*c* which are installed along a stopper distance S, so that a kinetic frictional force of the vehicle becomes a maximum stop frictional force in a state in which kinetic friction coefficients ($\mu_1$, $\mu_2$, $\mu_2$) of the first dragging kinetic frictional rolling force inducing member 40*a* and the second and third dragging kinetic frictional rolling force inducing members 40*b* and 40*c* are added.

Herein, $\mu_1$ is the kinetic friction coefficient of the first dragging kinetic frictional rolling force inducing member 40*a*, and $\mu_2$ is the kinetic friction coefficient of the second and third dragging kinetic frictional rolling force inducing members 40*b* and 40*c*. The dimension of $\mu_1$ and $\mu_2$ is $\mu_1 < \mu_2$. Since the kinetic friction coefficients $\mu_2$ of the second and third dragging kinetic frictional rolling force are equal to each other, the coefficient is simplified as $\mu_2$.

A number of stopper bolts 16 are installed to the guard rail 10 along the stopper distance S in a protruding manner to absorb all the remaining kinetic energy. The reason is for the safety of the passenger to the last.

In addition, the kinetic friction force inducing rolled tube 20 made of a soft material is installed in parallel with the guard rails 10 and 10 to absorb the impact energy with the kinetic frictional force and the rolling force. The installed position of the kinetic friction force inducing rolled tube 20 may be installed inside or outside the guard rails 10 and 10 if it is identical to the impact absorbing manner of the present invention. In addition, the number of the kinetic friction force inducing rolled tubes is not limited.

BRIEF DESCRIPTION OF THE DRAWINGS

The above objects, other features and advantages of the present invention will become more apparent by describing the preferred embodiments thereof with reference to the accompanying drawings, in which.

DETAILED DESCRIPTION

Figure 1:
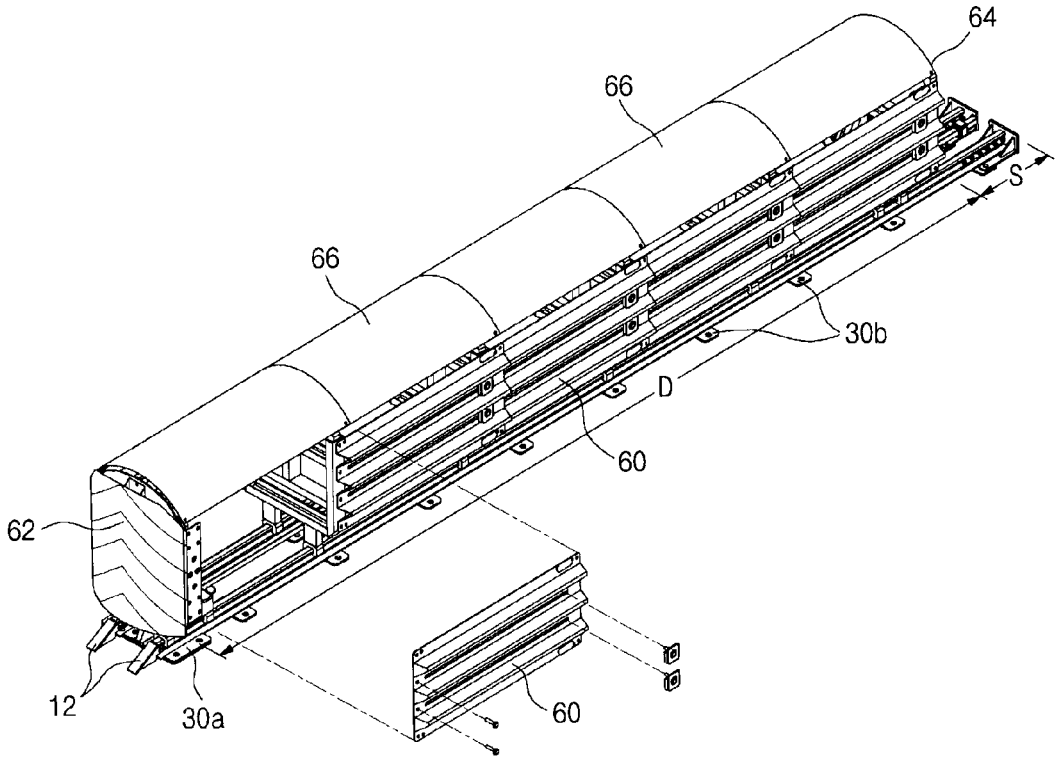
FIG. 1 is a perspective view illustrating a vehicle impact absorbing apparatus using a kinetic frictional force produced by dragging a surface of a rolled tube according to the present invention.

Next, the apparatus for absorbing vehicle impact using a kinetic frictional force produced by dragging a surface of a rolled tube will be described in detail.

There is provided an impact absorbing apparatus capable of absorbing kinetic energy of a vehicle using a kinetic frictional force produced by dragging a surface of a rolled tube, in which a barrier is supported by a guard rail via a support rail wheel, wherein a kinetic friction force inducing rolled tube 20 is installed in parallel with guard rails 10 and 10; a first dragging kinetic frictional rolling force inducing member 40*a*, a second dragging kinetic frictional rolling force inducing member 40*b*, a third dragging kinetic frictional rolling force inducing member 40*c*, a first dragging kinetic frictional rolling force inducing member guide 51*a* of a front barrier 50*a*, and a third dragging kinetic frictional rolling force inducing member guide 51*c* of a rear barrier 50*c* are inserted into the kinetic frictional force inducing rolled tube 20, in which the first dragging kinetic frictional rolling force inducing member 40*a* and the second and third dragging kinetic frictional rolling force inducing members 40*b* and 40*c* are overlapped each other to absorb the kinetic energy; the first dragging kinetic frictional rolling force inducing member 40*a* is installed in a front end portion of the kinetic frictional force inducing rolled tube 20 along a displacement D, the second dragging kinetic frictional rolling force inducing member 40*b* is installed inn intermediate portion thereof along the displacement D, and the third dragging kinetic frictional rolling force inducing member 40*c* is installed in the kinetic frictional force inducing rolled tube 20 along a stopper distance S; a kinetic friction inducing bolt 42*a* is inserted and fastened to a kinetic friction inducing bolt vertical bolt hole 44*a* of the first dragging kinetic frictional rolling force inducing member 40*a* to form a surface dragging inducting groove 21*a*, and kinetic friction inducing bolts 42*b* are inserted and fastened to a kinetic friction inducing bolt corner bolt holes 44*b* of the second dragging kinetic frictional rolling force inducing member 40*b* and the third dragging kinetic frictional rolling force inducing member 40*c* to form a corner dragging inducing groove 21*b*; and the surface dragging inducing groove 21*a* and the corner dragging inducing groove 21*b* are formed in a depth deeper than a surface and corner of the kinetic frictional force inducing rolled tube 20 at positions in which the kinetic friction inducing bolts 42*a* and 42*b* of the first dragging kinetic frictional rolling force inducing member 40*a* and the second and third dragging kinetic frictional rolling force inducing members 40*b* and 40*c* correspond to the kinetic frictional force inducing rolled tube 20.

The structure for the kinetic friction force inducing rolled tube 20 will be described.

The impact absorbing apparatus further comprises a fastening plate 24 provided with a fixing hole 24*a* and a fastening hole 24*b*, and a fastening hole 22, and a support bracket 27 having a coupling fixing plate 26 provided with a fixing bolt hole 29, wherein the fixing hole 24*a* of the fixing plate 24 corresponds to the fixing bolt hole 29 of the support bracket 27, and the fastening hole 24*b* of the fastening plate 24 corresponds to the fastening hole 22 of the kinetic frictional force inducing rolled tube 20, in which a fixing bolt 28 is fastened to the fixing bolt hole 29, and a fastening bolt 23 is fastened to the fastening hole 24*b* of the fastening plate 24.

A stopper bolt 16 protrudes through a stopper bolt hole 17, which is punched in a flange of the guard rail 10, along the stopper length S in which an intermediate barrier 50*b* and the front and rear barriers 50*a* and 50*c* are not installed. At the moment when the protruding stopper bolt 16 and the support rail wheels 52*a*, 52*b* and 52*c* of the barriers 50*a*, 50*b* and 50*c* collide against the stopper bolt 16, the stopper bolt 16 is ruptured to absorb the remaining kinetic energy.

A stopper 14 is installed at an end of the guard rail 10, at which the stopper distance S is zero, and is supported by the fixing plate 14*a* and the support bracket 14*b*. The reason is to prevent the vehicle from crossing the stopper 14.

A magnitude of a kinetic friction coefficient of the kinetic friction force inducing rolled tube 20, the first dragging kinetic frictional rolling force inducing member 40*a* and the second and third dragging kinetic frictional rolling force inducing members 40*b* and 40*c* is adjusted by rotation and pressurization of the kinetic friction inducing bolts 42*a* and 42*b*.

The present invention relates to the impact absorbing method using the kinetic friction coefficient to slowly maintain the deceleration at the initial collision the first to third dragging kinetic frictional rolling force inducing members 40*a* to 40*c* have the relationship of $\mu_1<\mu_2$. The magnitude of the kinetic friction coefficients of the first dragging kinetic frictional rolling force inducing member 40*a* and the second and third dragging kinetic frictional rolling force inducing members 40*b* and 40*c* can be adjusted by rotation and pressurization of the kinetic friction inducing bolts 42*a* and 42*b*.

The number of the first dragging kinetic frictional force inducing members 40*a* and the second and third dragging kinetic frictional rolling force inducing members 40*b* and 40*c* which are inserted into the kinetic frictional force inducing rolled tube 20 can be selected depending upon a magnitude of the impact energy of the vehicle.

The relationship between the kinetic friction coefficients $\mu_1$ and $\mu_2$ of the first dragging kinetic frictional rolling force inducing member 40*a* and the second and third dragging kinetic frictional rolling force inducing members 40*b* and 40*c* and the kinetic friction force inducing rolled tube 20 will be described.

Since the maximum deceleration of the vehicle to the impact absorbing apparatus is represented at the initial collision, the kinetic friction coefficient $\mu_1$ should be slow so that the maximum deceleration is 20 g or less. After the maximum deceleration, the kinetic friction coefficient cannot exceed the maximum deceleration even though the kinetic friction coefficient $\mu_2$ is higher than the kinetic friction coefficient $\mu_1$. The reason is that after the maximum deceleration the velocity is significantly less than the initial impact instant velocity.

The present invention is configured to slowly maintain the maximum deceleration by the kinetic friction coefficients $\mu_1$ and $\mu_2$ of the first dragging kinetic frictional rolling force inducing member 40*a* and the second and third dragging kinetic frictional rolling force inducing members 40*b* and 40*c* and the kinetic friction force inducing rolled tube 20.

The kinetic friction coefficient $\mu_1$ is a kinetic friction coefficient between the surface of the kinetic friction force inducing rolled tube 20 and the dragging kinetic frictional force inducing member, while the kinetic friction coefficient $\mu_2$ is a kinetic friction coefficient between the corner of the kinetic friction force inducing rolled tube 20 and the ragging kinetic frictional rolling force inducing member.

The kinetic friction inducing bolts 42*a* and 42*b* are made of a hard material, and the kinetic friction force inducing rolled tube 20 is made of a soft material. If the kinetic friction force inducing rolled tube 20 is made of a hard material, it will be torn by means of the kinetic friction inducing bolts 42*a* and 42*b*. If the kinetic friction force inducing rolled tube 20 is torn, the maximum deceleration resulted from the kinetic frictional force is abruptly changed, thereby being fatal to the passenger. The goal of the present invention is to slowly maintain the maximum deceleration, in which the kinetic friction inducing bolts 42*a* and 42*b* made of the hard material drag the kinetic friction force inducing rolled tube 20 made of the soft material to maintain the kinetic friction coefficients $\mu_1$ and $\mu_2$ and thus absorb the kinetic energy.

The state, in which the kinetic friction inducing bolts 42*a* and 42*b* drag the surface and corner portion of the kinetic friction force inducing rolled tube 20, means that the surface and corner portion of the kinetic friction force inducing rolled tube 20 is not torn, but is caved by dragging action of the kinetic friction inducing bolts 42*a* and 42*b* so that the surface is thinly rolled and cut to continuously produce the kinetic frictional force.

The kinetic friction inducing bolts 42*a* and 42*b* are made of a hard material, and the kinetic friction force inducing rolled tube 20 is made of a soft material, in which the surface and corner portion of the kinetic friction force inducing rolled tube 20 is not torn, but is caved by dragging action of the kinetic friction inducing bolts 42*a* and 42*b* so that the surface is thinly rolled and cut to continuously absorb the kinetic energy.

ADVANTAGEOUS EFFECTS

The present invention is configured to continuously secure the displacement while the dynamic kinetic energy of the vehicle is absorbed by the kinetic frictional force produced by dragging the surface of the soft rolled tube, and to maintain the evaluation index of PHD less than 20 g by slowly maintaining the maximum deceleration applied to the vehicle and passenger, thereby preventing a human in safe against fatal impact.

The maximum deceleration is reduced by 20 g or less by the kinetic frictional force of the first dragging kinetic frictional force inducing member at the front end portion of the rolled tube, in which the dynamic kinetic energy of the vehicle is the highest, the kinetic energy is significantly reduced by the second dragging kinetic frictional rolling force inducing member having the kinetic friction coefficient larger than that of the first dragging kinetic frictional force inducing member at the intermediate portion of the rolled tube, and the remaining kinetic energy is wholly absorbed by the third dragging kinetic frictional rolling force inducing member installed along the stopper distance.

The first dragging kinetic frictional force inducing member and the second dragging kinetic frictional rolling force inducing member are inserted into the kinetic frictional force inducing rolled tubes along the displacement D, and the third dragging kinetic frictional rolling force inducing member is inserted along the stopper distance S, thereby pressing, deforming and sliding the soft surface and corner of the rolled tube. Therefore, it is possible to recycle the impact absorbing apparatus by replacing only the damaged rolled tube.

Since the present invention is configured to adjust the magnitude of the kinetic friction coefficient, it is possible to easily manufacture the optimum impact absorbing apparatus with a simple structure.

The impact absorbing apparatus according to the present invention includes the simple configuration and can be easily manufactured since the kinetic frictional force inducing rolling tube is installed to an existing guard rail, and the first and third dragging kinetic frictional force inducing member guides, the first dragging kinetic frictional force inducing member, and the second and third dragging kinetic frictional rolling force inducing members are installed to the rolled tube.

DESCRIPTION OF REFERENCE NUMERALS IN THE FIGURES

10: Guard rail
D: Displacement
S: Stopper Distance
12: Inclined Rail
12*a*: Fastening Bolt
14: Stopper
14*a*: Fixing Plate
142*a*: Fixing Hole
14*b*: Bracket
16: Stopper Bolt
17: Stopper Bolt Hole
20: Kinetic Frictional Force Inducing Rolled Tube
21*a*: Surface Dragging Inducting Groove
21*b*: Corner Dragging Inducting Groove
22: Fastening Hole
23: Fastening Bolt
24: Fastening Plate
24*a*: Fastening Hole
24*b*: Fixing Hole
24*c*: Damping Rubber Plate
25: Reinforcing Plate
26: Coupling Fixing Plate
26*a*: Anchor Hole
27: Support Bracket
28: Fixing Bolt
29: Fixing Bolt Hole
30 Fixing Plate
30*a*: Front Fixing Plate
30*b*: Intermediate Fixing Plate
30*c*: Rear Fixing Plate
32: Fixing Anchor Hole
40: Dragging kinetic Frictional Rolling Force Inducing Member
40*a*: First Dragging Kinetic Frictional Rolling Force Inducing Member
42*a*: Kinetic Frictional force Inducting Bolt
44*a*: Kinetic Frictional force Inducting Bolt Vertical Bolt Hole
40*b*: Second Dragging kinetic Frictional Rolling Force Inducing Member
42*b*: Kinetic Frictional force Inducting Bolt
44*b*: Kinetic Frictional force Inducting Bolt Corner Bolt Hole
44*c*: Third Dragging Kinetic Frictional force Inducing Member
50: Barrier
502: Lateral Guard Panel or Wire Cable Support
52: Support Rail Wheel
50*a*: Front Barrier
51*a*: First Dragging Kinetic Frictional Rolling Force Inducing Member Guide
52*a*: Front Barrier Support Rail Wheel
53*a*: Longitudinal Member
54*a*: Transverse Member
55*a*: Vertical Member
56*a*: Horizontal Member
57*a*: Inclined Support member
58*a*: Support Member
50*b*: Intermediate Barrier
52*b*: Intermediate Barrier Support Rail Wheel
55*b*: Vertical Member
56*b*: Horizontal Member
58*b*: Support Member
50*c*: Rear Barrier
51*c*: Third Dragging Kinetic Frictional Rolling Force Inducing Member Guide
52*c*: Rear Barrier Support Rail Wheel
54*c*: Longitudinal Member
55*c*: Vertical Member
56*c*: Horizontal Member
57*c*: Inclined Support Member
58*c*: Support Member
60: Lateral Guard Panel
60*a*: Wire Cable
61: Fastening Bolt
62: Front Panel
64: Rear Panel
66: Upper Panel

BEST MODE

Now, a preferred embodiment of the present invention will be described in detail with reference to the accompanying drawings. The embodiment described below is merely exemplary and is not to be construed as limiting the present invention. The description of the present invention is intended to be illustrative, and not to limit the scope of the claims. In the description of the embodiment of the present invention, the same drawing reference numerals are used for the same elements even in different drawings, and the duplicate explanation thereof will be omitted.

The present invention includes a pair of guard rails 10 and 10, and kinetic frictional force inducing rolled tubes 20 which are installed in parallel with the guard rails 10 and 10, in which the guard rails 10 are divided into a displacement D and a stopper distance S. Front and rear barriers 50*a* and 50*c* and an intermediate barrier 50*b* are installed only in the displacement D, and nut installed in the stopper distance S. Support rail wheels 52*a*, 52 and 52*c* of the front and rear barriers 50*a* and 50*c* and the intermediate barrier 50*b* are inserted and supported into the guard rails 10.

A first dragging kinetic frictional rolling force inducing member 40*a* and a second dragging kinetic frictional rolling force inducing member 40*b* are inserted into the kinetic frictional force inducing rolled tubes 20 along the displacement D, and a third dragging kinetic frictional rolling force inducing member 40*c* is inserted along the stopper distance S. First dragging kinetic frictional rolling force inducing member guide 51*a* of the front barrier 50*a* is installed in front of the inserted the first dragging kinetic frictional rolling force inducing member 40*a*, and a third dragging kinetic frictional rolling force inducing member guide 51*c* of the rear barrier 50*c* is installed in front of the third dragging kinetic frictional rolling force inducing member 40*c*.

If a vehicle is impacted, the first dragging kinetic frictional rolling force inducing member guide 51*a* of the front barrier 50*a* first pushes the first dragging kinetic frictional rolling force inducing member 40*a*, and then pushes the second dragging kinetic frictional rolling force inducing member 40*b* and the third dragging kinetic frictional rolling force inducing member 40*c* of the rear barrier 50*c*. In this process, the first dragging kinetic frictional rolling force inducing member 40*a* and the second and third dragging kinetic frictional rolling force inducing members 40*b* and 40*c* are dragged to generate the kinetic frictional force which absorbs the kinetic energy. The stopper distance S is a region in which the kinetic frictional force produced by the kinetic energy is changed to the maximum stop frictional force, and the kinetic frictional force is zero in this region.

For the sake of passenger's safe, it is preferable that stopper bolts 16 provided at the guard rails 10 are ruptured by the support rail wheels 52*a*, 52*b* and 52*c* of the barrier to absorb the remaining kinetic energy in preparation for the case wherein a little kinetic energy is left.

Figure 2:
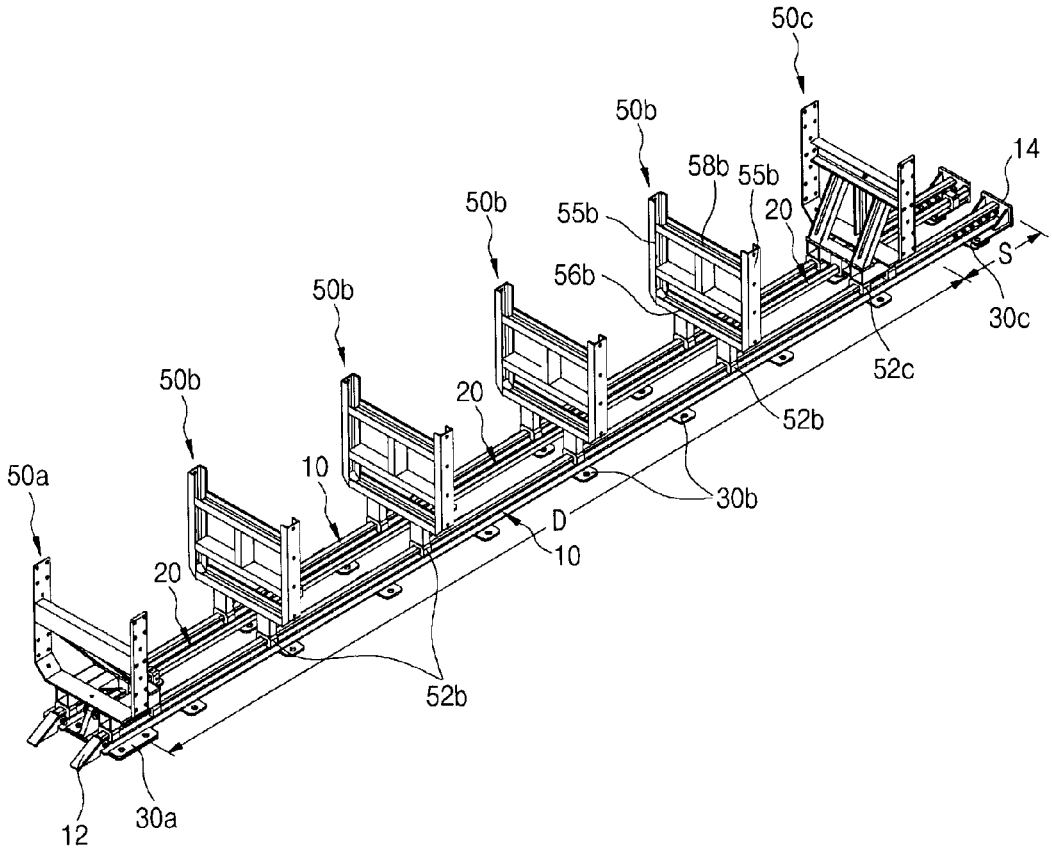
FIG. 2 is a perspective view illustrating the state in which front, rear and intermediate barriers of the vehicle impact absorbing apparatus according to the present invention are installed at a displacement between a guard rail and the rolled tube.
Figure 3:
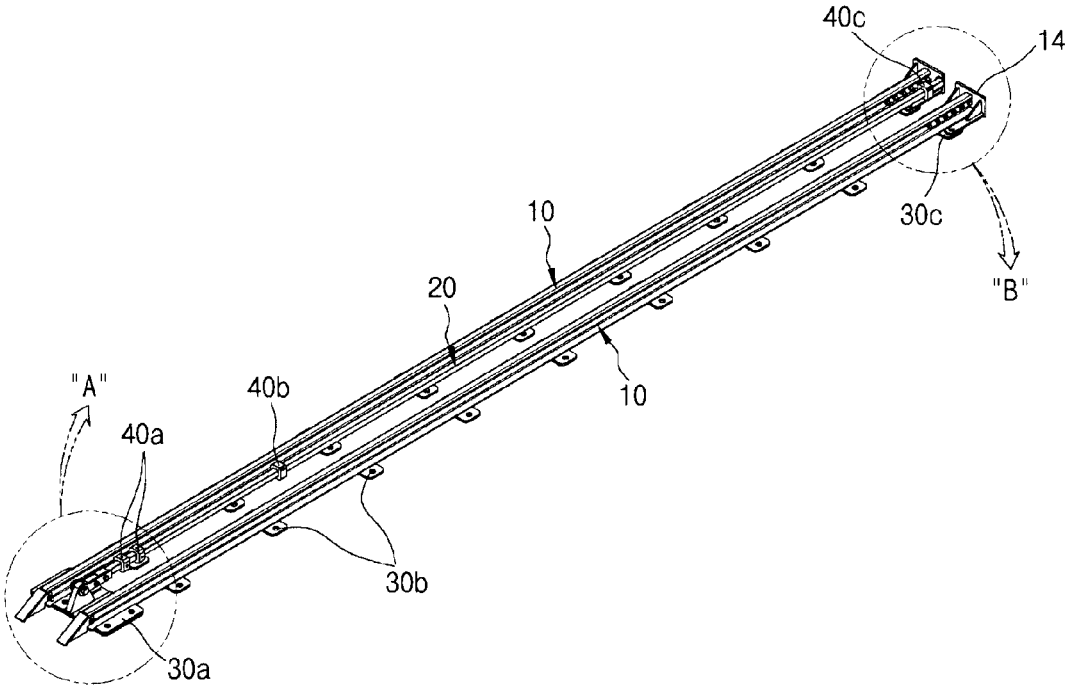
FIG. 3 is a perspective view illustrating installed positions of the guard rail and the rolled tube in the vehicle impact absorbing apparatus according to the present invention.
Figure 4:
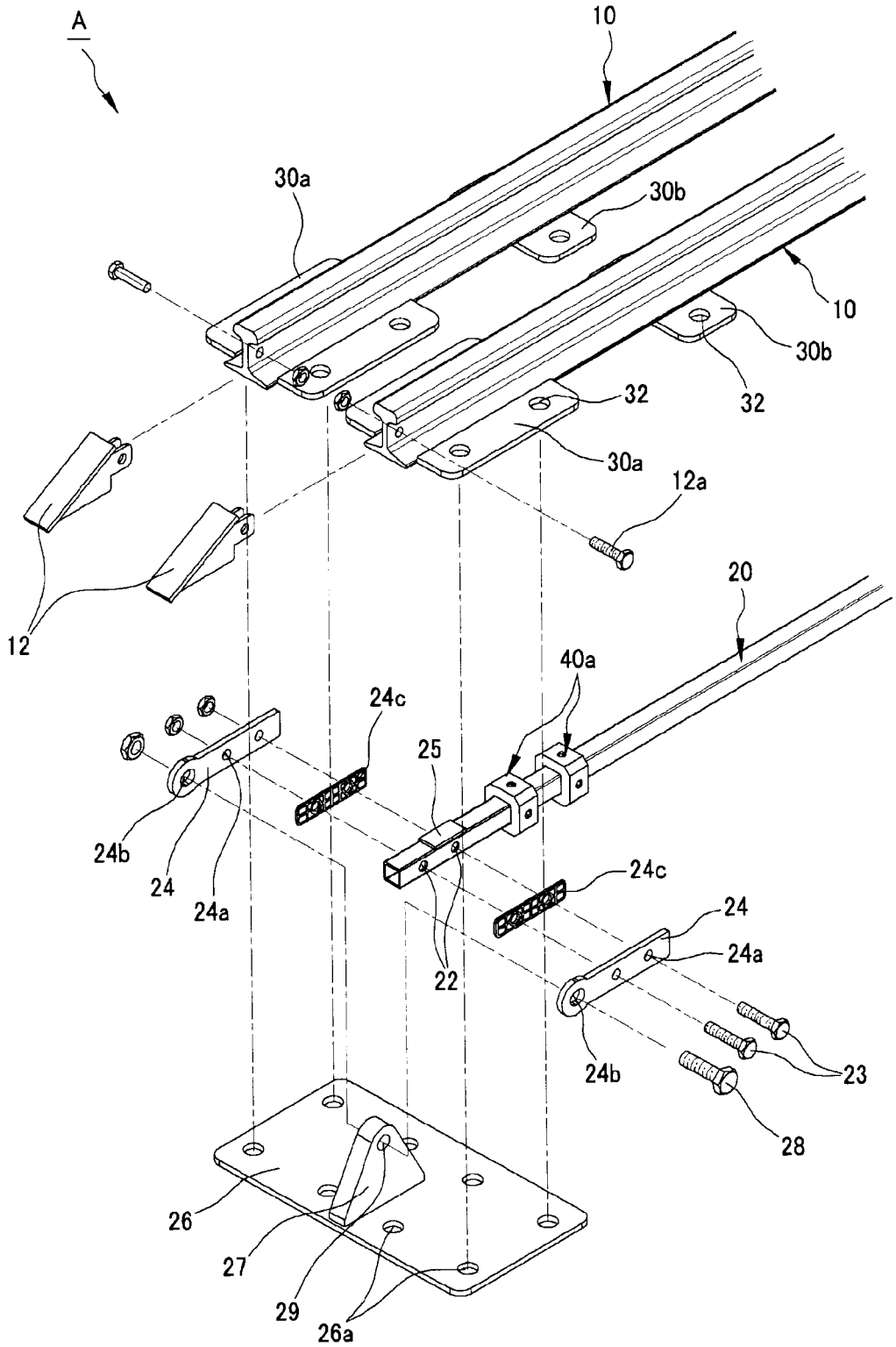
FIG. 4 is an exploded perspective view of the circle A in FIG. 3.
Figure 5:
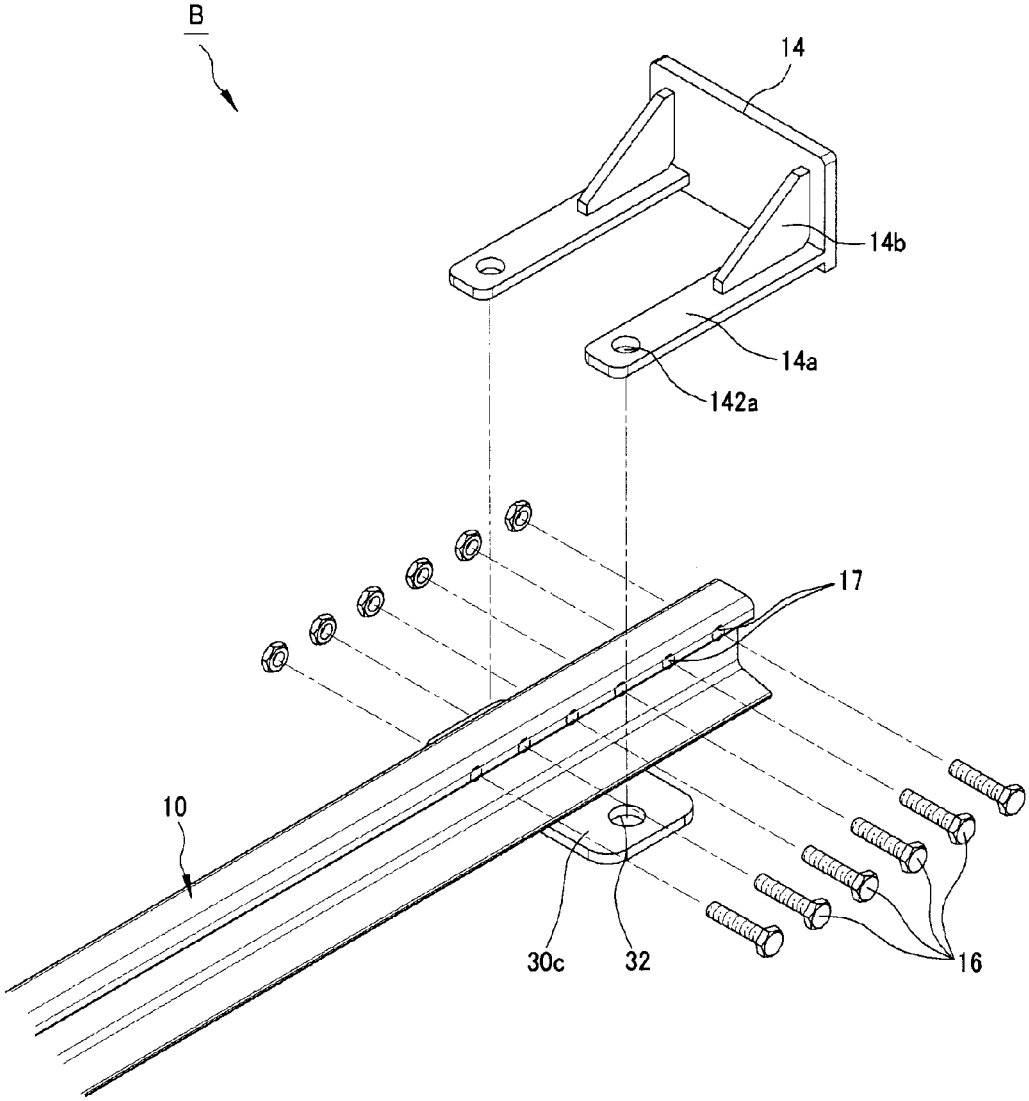
FIG. 5 is an exploded perspective view of the circle B in FIG. 3.
Figure 6:
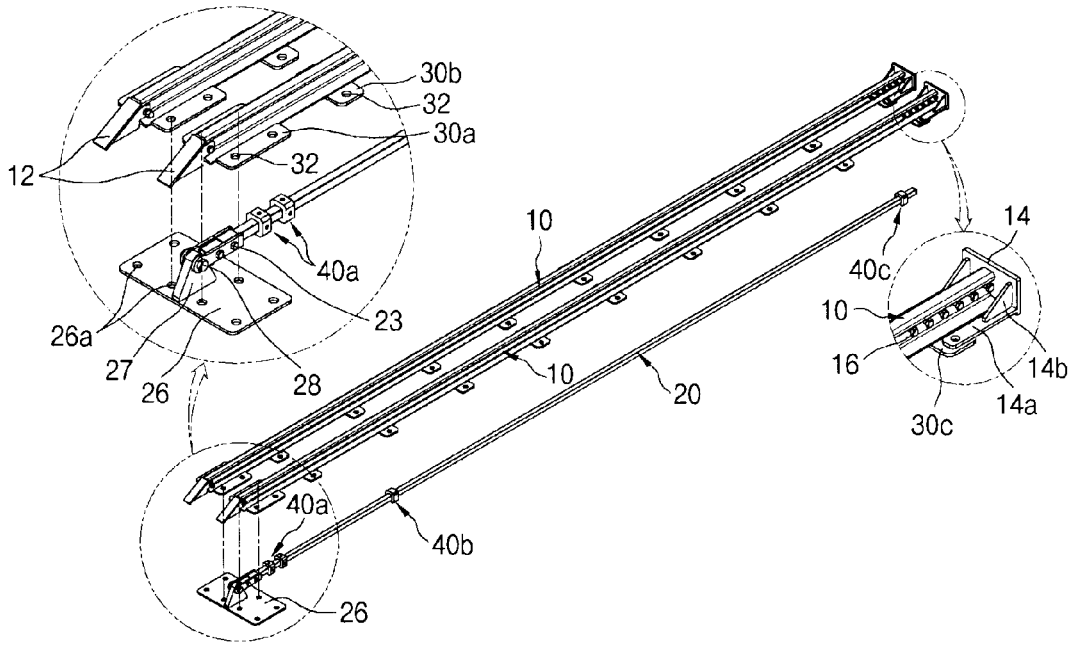
FIG. 6 is an exploded perspective view illustrating the guard rail and the rolled tube of the vehicle impact absorbing apparatus according to the present invention.
Figure 7:
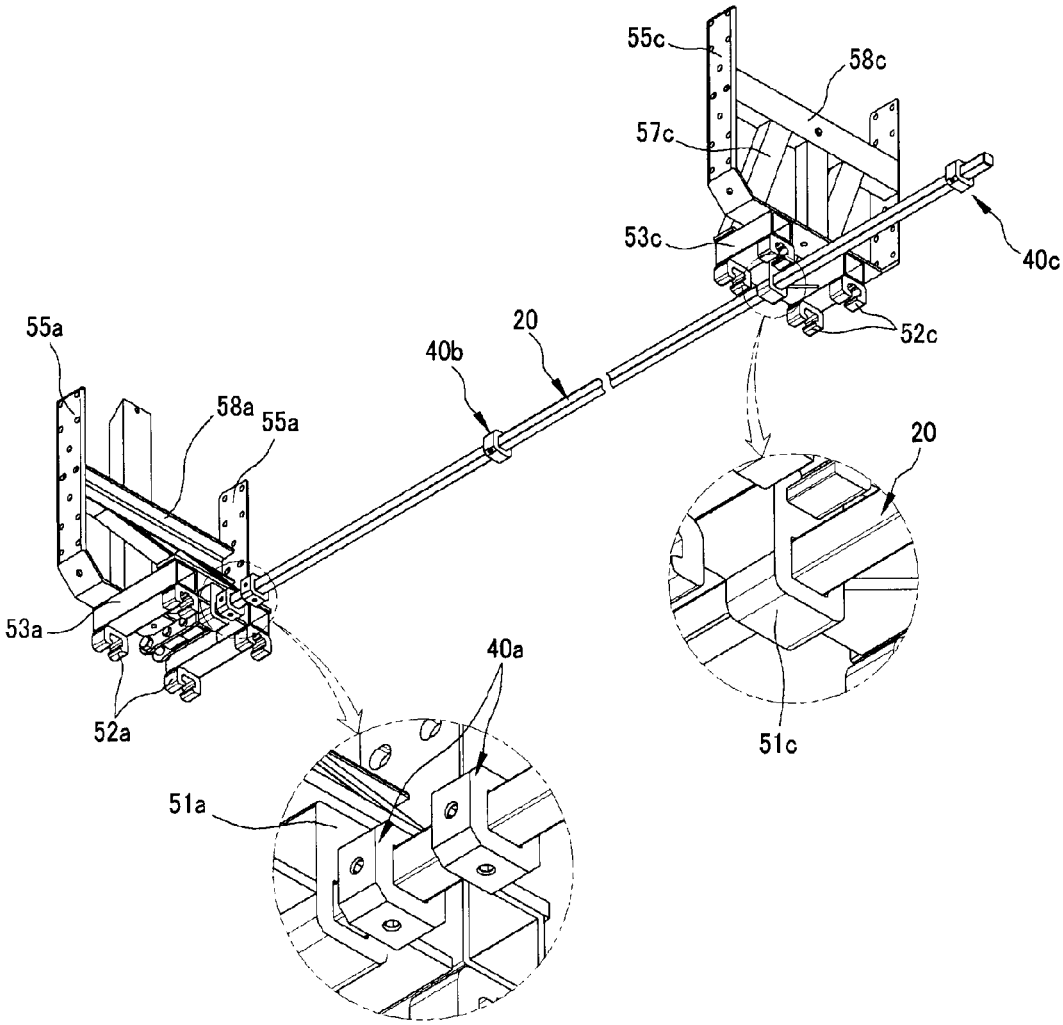
FIG. 7 is a perspective view illustrating the relationship between first and second dragging kinetic frictional force inducing member guides of the front and rear barrier and first dragging kinetic frictional force inducing member inserted into the rolled tube in the vehicle impact absorbing apparatus according to the present invention.
Figure 8:
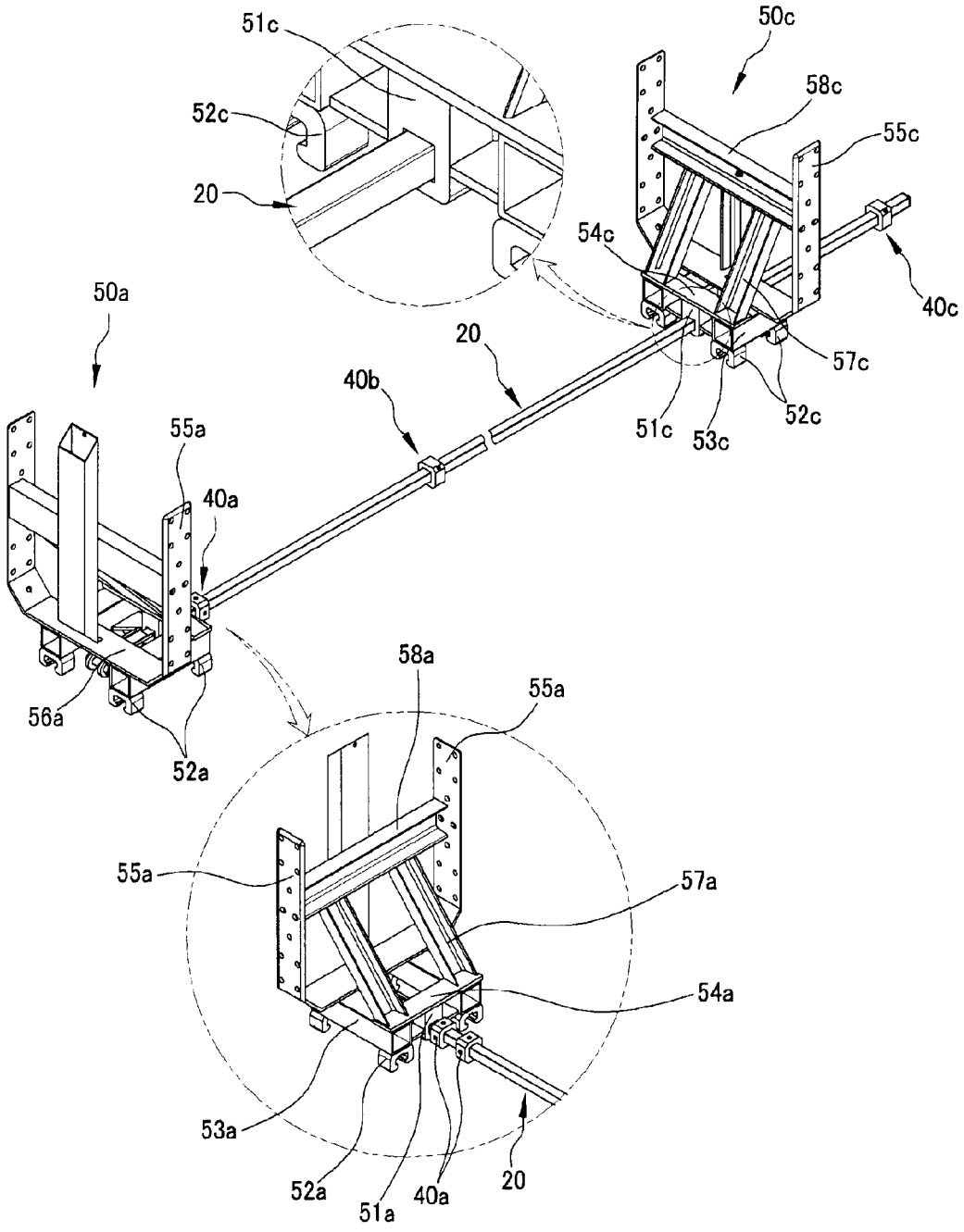
FIG. 8 is a perspective view illustrating the front and rear barrier in the vehicle impact absorbing apparatus according to the present invention.
Figure 9:
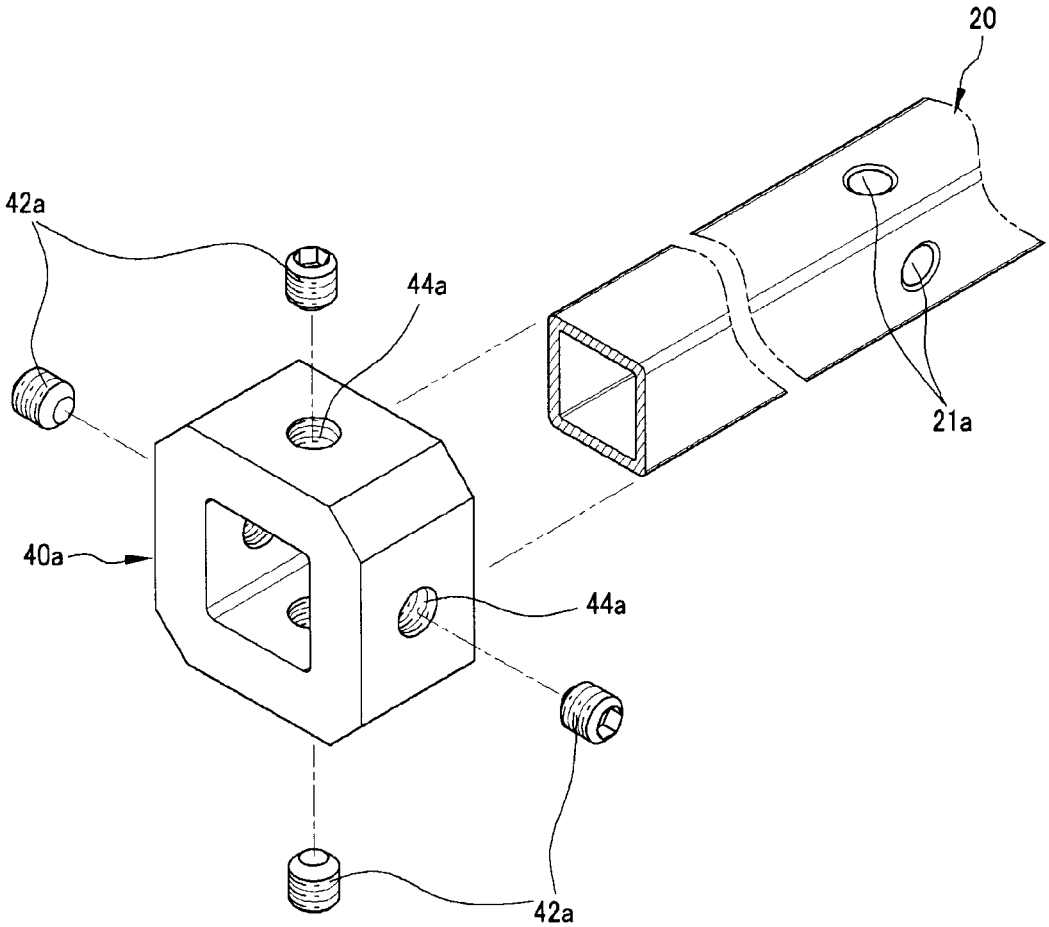
FIG. 9 is an exploded perspective view illustrating the rolled tube into which the first dragging kinetic frictional force inducing member is inserted.
Figure 10:
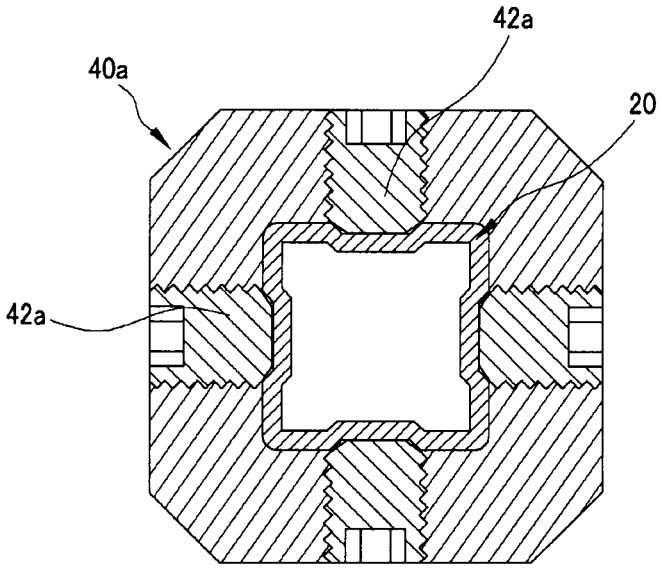
FIG. 10 is a cross-sectional view illustrating the state in which the first dragging kinetic frictional force inducing member shown in FIG. 9 is coupled to the rolled tube.
Figure 11:
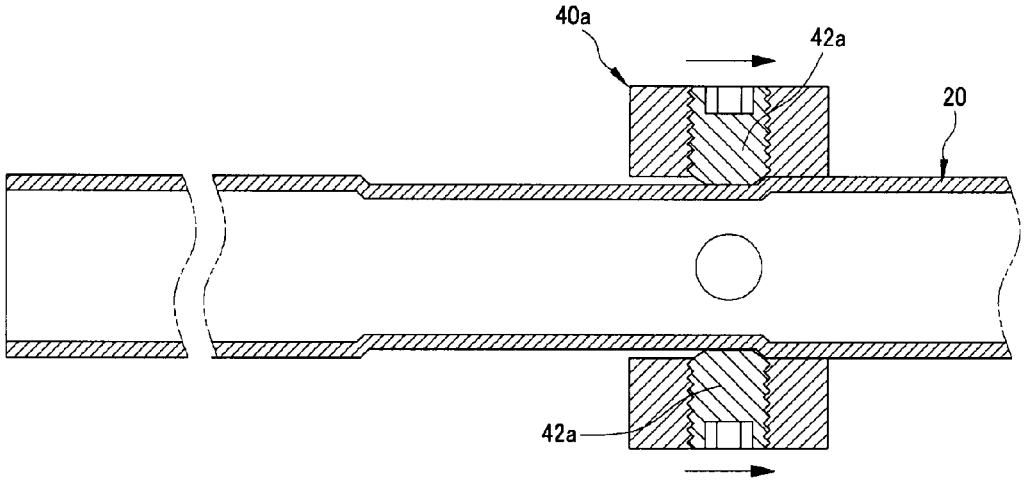
FIG. 11 is a view illustrating the state in which the rolled tube is dragged by the first dragging kinetic frictional force inducing member in the cross-sectional view of FIG. 10.
Figure 12:
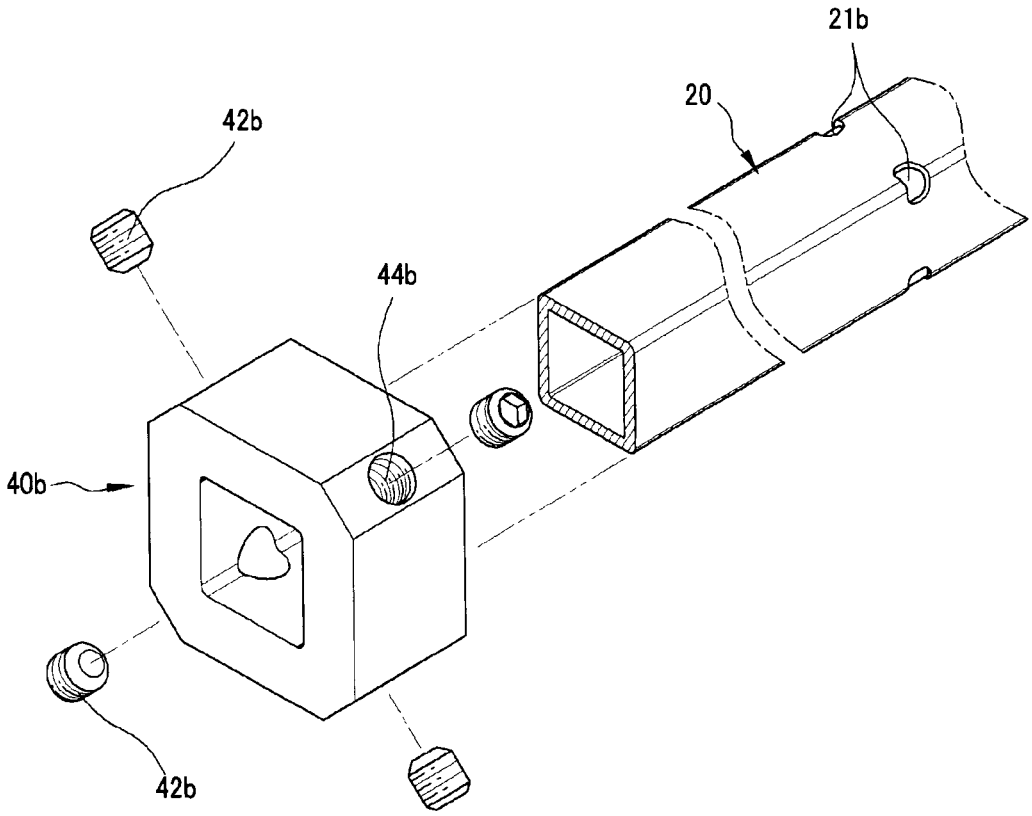
FIG. 12 is an exploded perspective view illustrating the rolled tube into which the second and third dragging kinetic frictional force inducing members are inserted.
Figure 13:
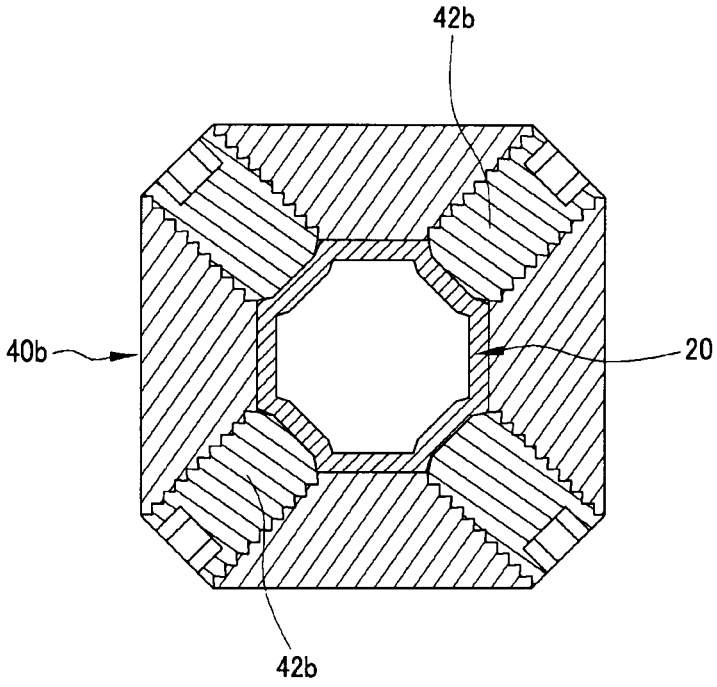
FIG. 13 is a cross-sectional view illustrating the state in which the second and third dragging kinetic frictional force inducing members shown in FIG. 12 are coupled to the rolled tube.
Figure 14:
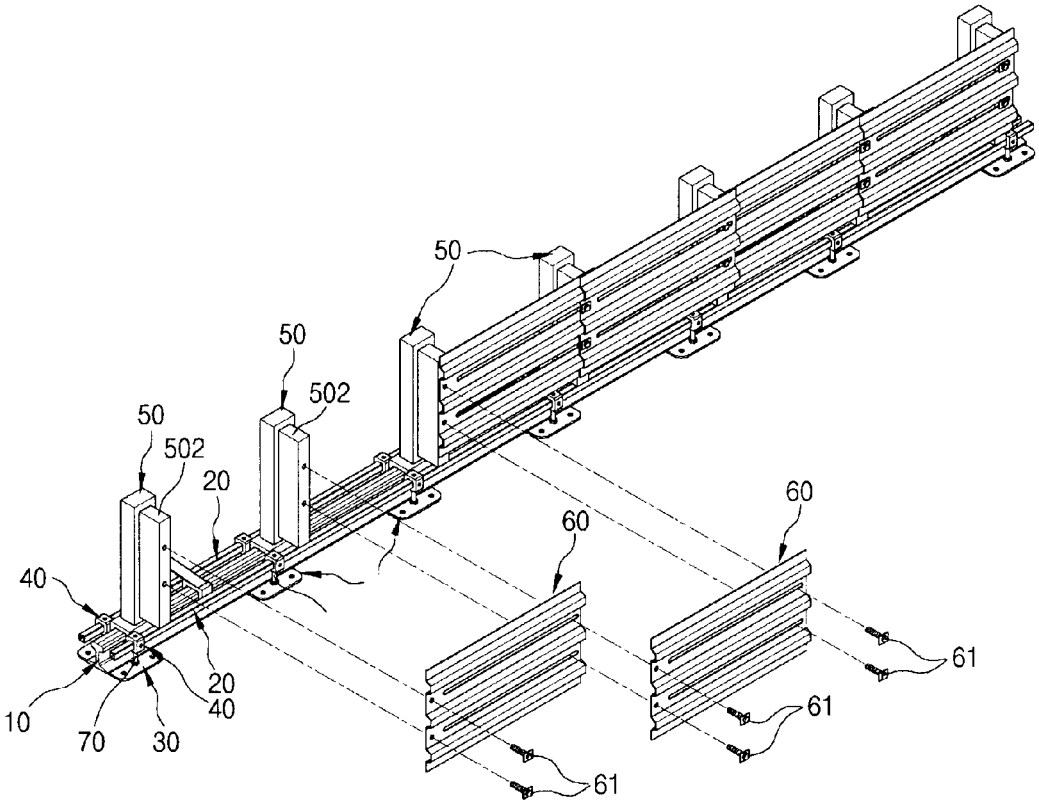
FIGS. 14 and 15 are perspective view of other embodiments of the present invention.
Figure 15:
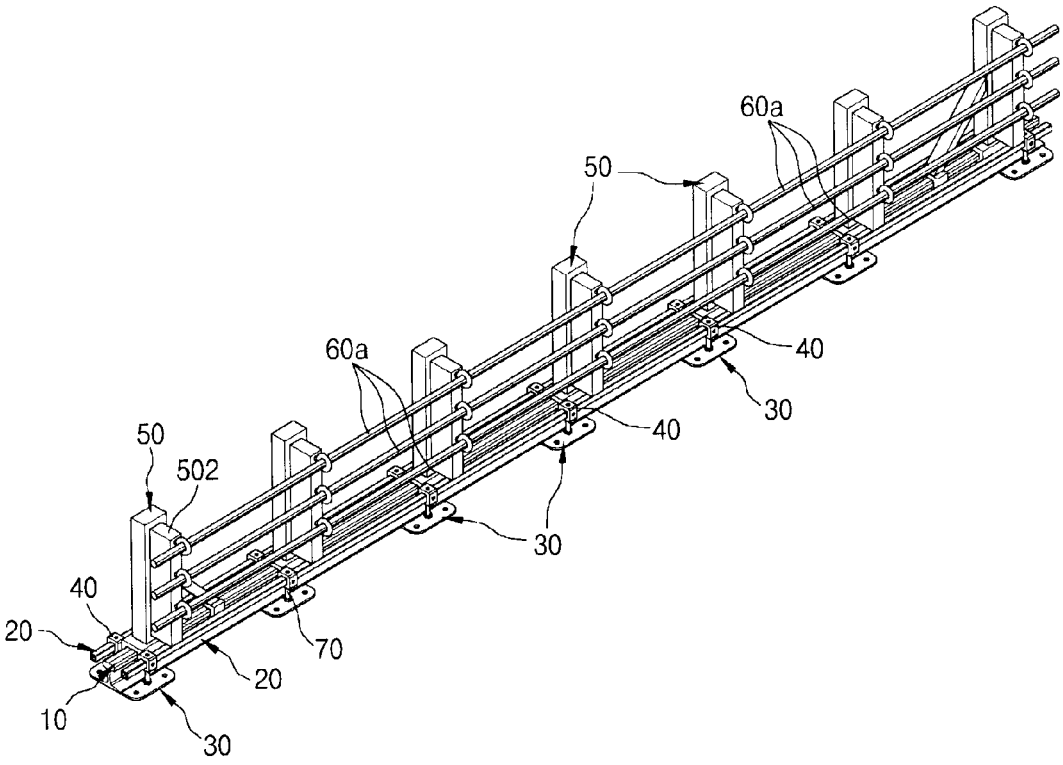
Figure 16:
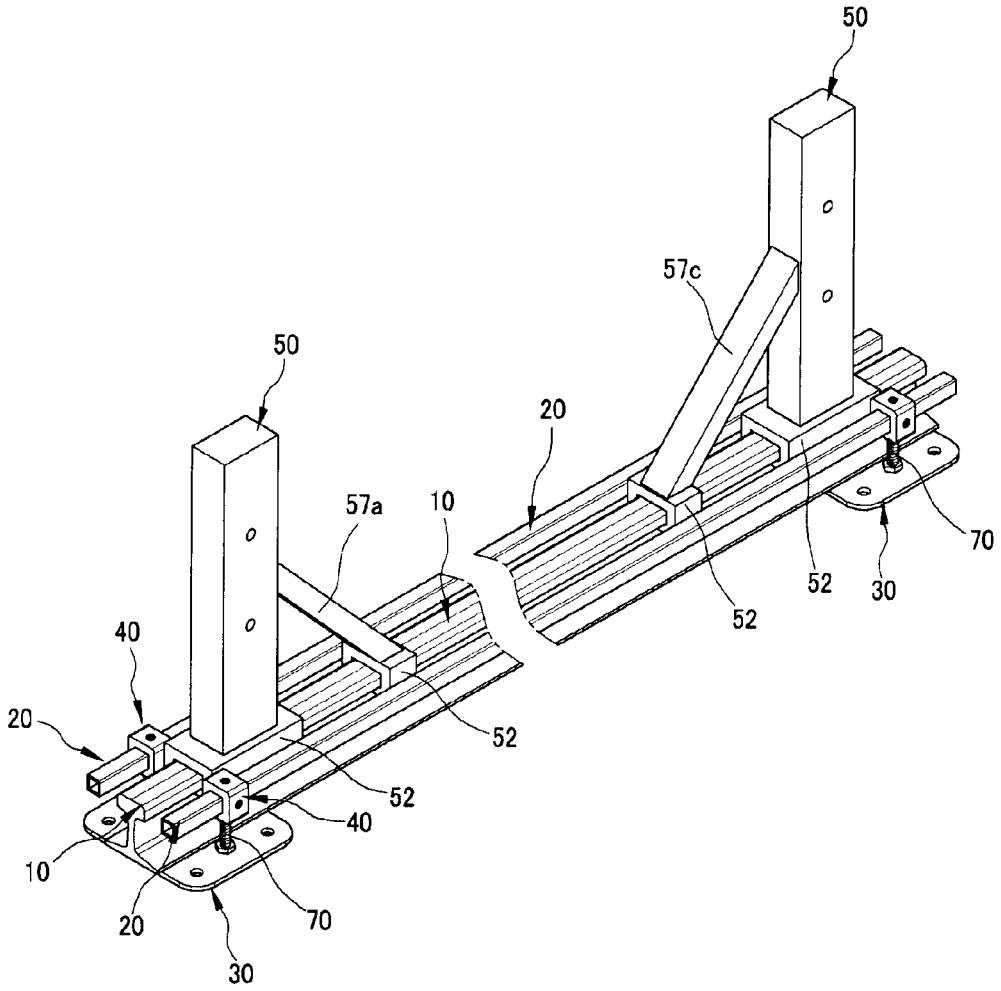
FIGS. 16 and 17 are an enlarged perspective view and an exploded view illustrating main components shown in FIGS. 14 and 15.
Figure 17:
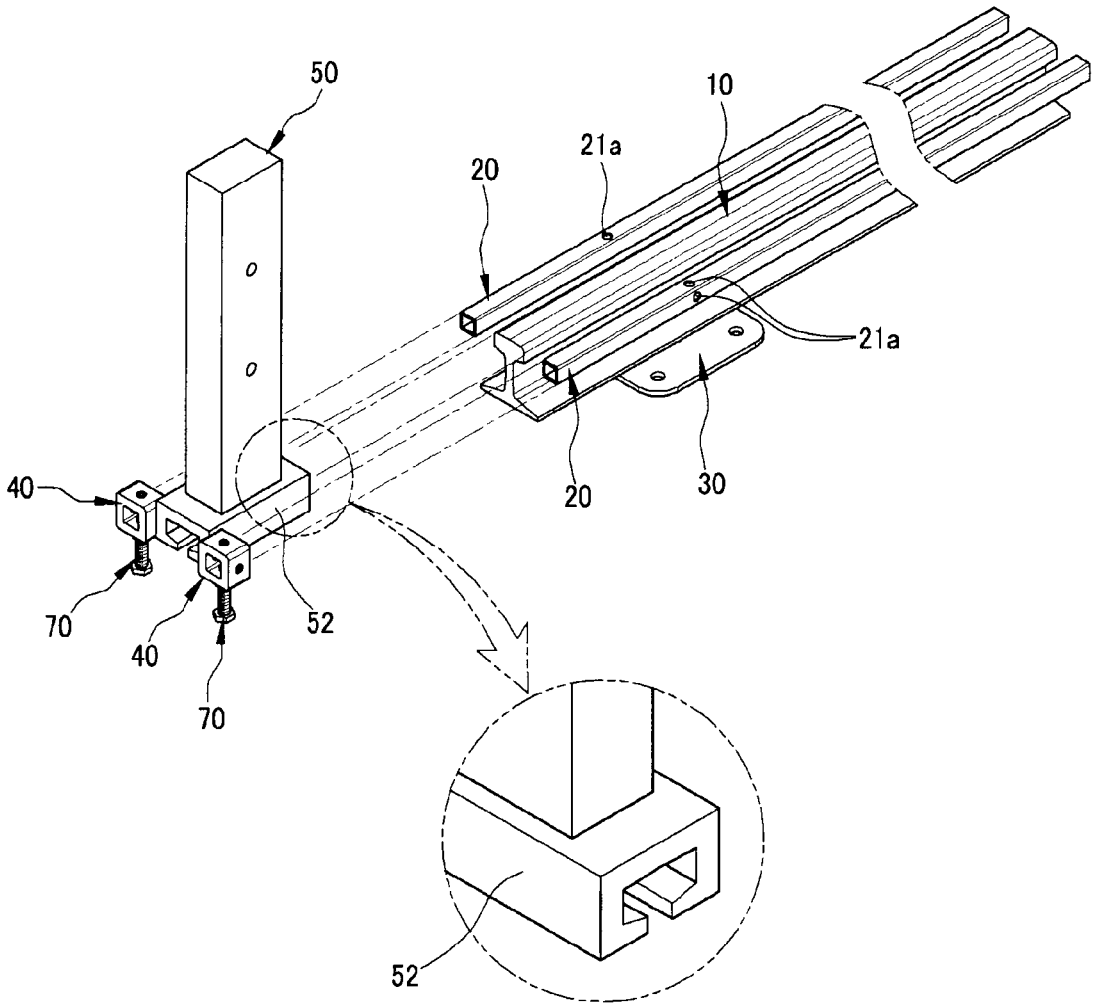
Figure 18:
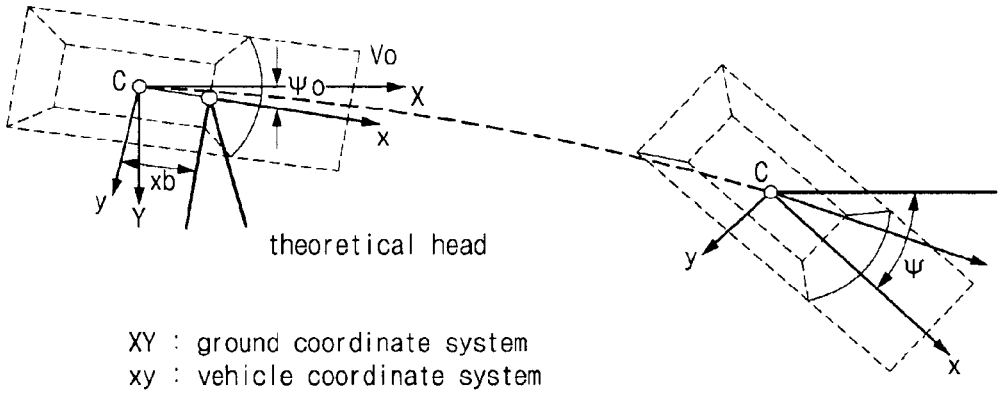
FIG. 18 shows a relationship between a deceleration of a vehicle and a relative velocity (Vo) of a passenger's head.
Figure 19:
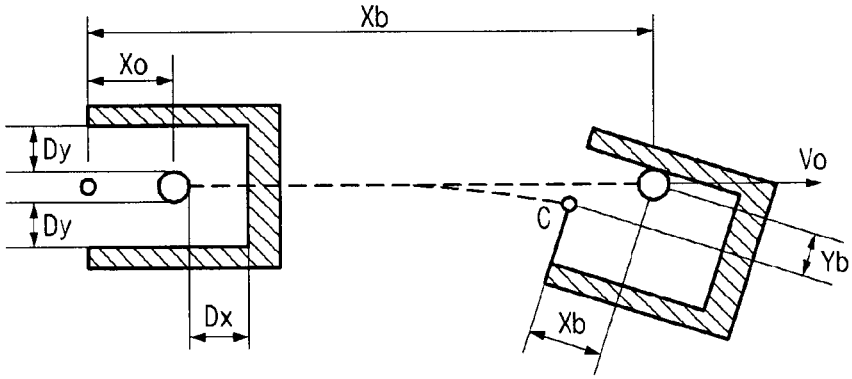
FIG. 19 shows a flight distance of a passenger's head.
Figure 20:
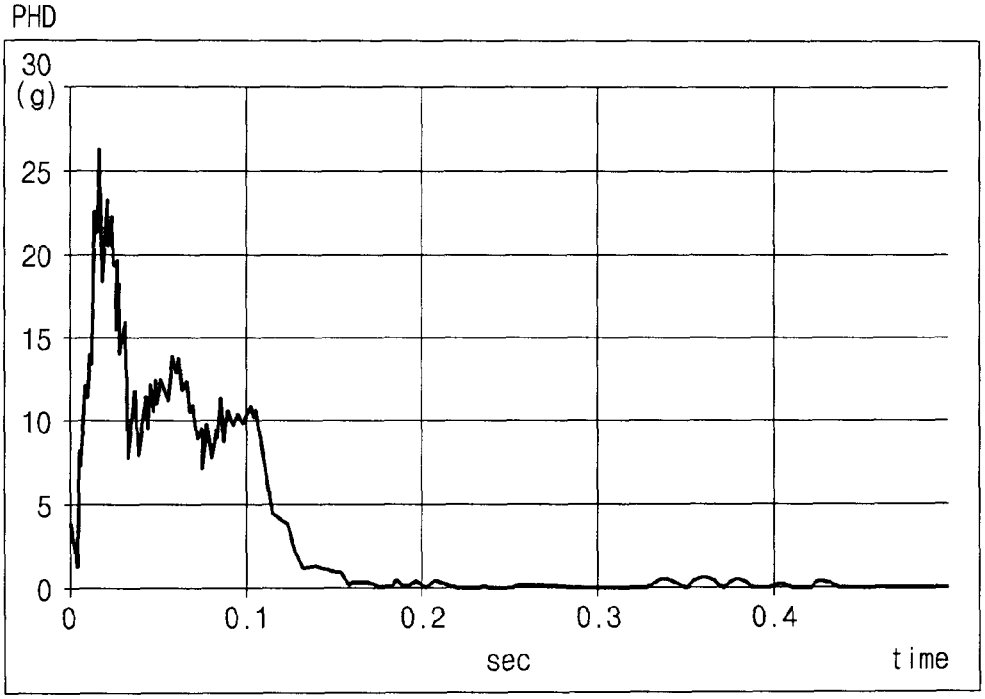
FIG. 20 is a graph illustrating a deceleration of the passenger's head to a time after the head collides against the safety facility.

FIG. 2 is a cross section of a surface dragging inducting groove 21*a* and a corner dragging inducting groove 21*b*, on which kinetic friction inducting bolts 42*a* and 42*b* of the first dragging kinetic frictional rolling force inducing member 40*a* and the second third second dragging kinetic frictional rolling force inducing members 40*b* and 40*c* are located at the kinetic frictional force inducing rolled tube 20. FIG. 2 shows the state in which the kinetic friction inducting bolts 42*a* and 42*b* drag on the surface dragging inducting groove 21*a* and the corner dragging inducting groove 21*b* to induce the kinetic frictional force. The dragged trace formed on the surface of the kinetic frictional force inducing rolled tube 20 is deeply caved by the surface dragging inducting groove 21*a* and the corner dragging inducting groove 21*b* in the state in which the surface is slightly cut without being torn (see FIGS. 9 and 12). The depth of the dragged groove formed on the surface of the kinetic frictional force inducing rolled tube 20 can be adjusted by screw adjustment of the kinetic friction inducting bolts 42*a* and 42*b*.

A kinetic friction coefficient $\mu_1$ of the surface dragging inducting groove 21*a* of the first dragging kinetic frictional rolling force inducing member 40*a* is lower than a kinetic friction coefficient $\mu_2$ of the corner dragging inducting groove 21*b* of the second and third dragging kinetic frictional rolling force inducing members 40*b* and 40*c*. Since the third dragging kinetic frictional rolling force inducing member 40*c* is equal to the second dragging kinetic frictional rolling force inducing member 40*b*, only the second dragging kinetic frictional rolling force inducing member 40*b* will be described herein.

The guard rails 10 are firmly installed onto a front fixing plate 30*a*, an intermediate fixing plate 30*b* and a rear fixing plate 30*c* each having fixing anchor holes 32. An inclined rail 12 is fastened to the guard rails 10 by fastening bolts 12*a*. The kinetic frictional force inducing rolled tube 20 is firmly installed to a fastening plate 24 and a support bracket 27 integrally formed with a coupling fixing plate 26 by means of fastening bolts 23 and fixing bolts 28. The kinetic frictional force inducing rolled tube 20 is fixed by anchor in the state in which the anchor hole 26*a* of the coupling fixing plate 26 coincides with the fixing anchor hole 32 of the front fixing plate 30*a*. Reference numeral 24*c* denotes a damping rubber plate.

A stopper 14 is installed to the end portion of the guard rail 10, at which the stopper distance S is zero, and is supported by the fixing plate 14*a* and the support bracket 14*b*. The stopper 14 is fixed by anchor in the state in which the fixing hole 142*a* of the fixing plate 14*a* coincides with the fixing anchor hole 32 of the rear fixing plate 30*c*.

The front and rear barriers 50*a* and 50*c* and the intermediate barrier 50*b* are installed by the displacement D, and a lateral guard panel 60, a front panel 62, a rear panel 64 and an upper panel 66 are installed in the state in which the first dragging kinetic frictional rolling force inducing member 40*a* and the second dragging kinetic frictional rolling force inducing member 40*b* are inserted into the kinetic frictional force inducing rolled tubes 20 along by the displacement D and the third dragging kinetic frictional rolling force inducing member 40*c* is inserted into the kinetic frictional force inducing rolled tubes 20 along the stopper distance S.

In the vehicle impact absorbing apparatus using the kinetic frictional force produced by dragging the surface of the rolled tube according to another embodiment of the present invention, if only the positions of the guard rail 10 and the kinetic frictional force inducing rolled tubes 20 are changed, it can be preferably applied to the front end of the guard rail installed on a road shoulder or the front of a median strip (see FIGS. 14 to 17). The impact absorbing concept using the kinetic frictional force produced by dragging the surface of the rolled tube is same.

Another embodiment will be described in detail with reference to FIGS. 14 to 17.

The kinetic frictional force inducing rolled tubes 20 and 20 with the surface dragging inducing groove 21*a* are installed at both sides of the guard rail 10, and are fixed by a height adjustment support 70. The lower end portion of the height adjustment support 70 is fixed to the fixing plate 30, and the upper end portion is fixed to the support rail wheel 52. The lower end of the barrier 50 is firmly welded to the upper end of the support rail wheel 52, and the side of the support rail wheel 52 is firmly welded to the side of the dragging kinetic frictional rolling force inducing member 40 which is inserted into the kinetic frictional force inducing rolled tube 20.

A lateral guard panel or wire cable support 502 is fixed to the side of the barrier 50. The lateral guard panel or wire cable support 502 is a member for fixing the lateral guard panel 60 or the wire cable 60*a*. Since the lateral guard panel 60 or the wire cable 60*a* is not directly fixed to the barrier 50, the lateral guard panel or wire cable support 502 serves as a medium member for filling the interval.

In the description of the embodiment of the present invention, the same drawing reference numerals are used for the same elements even in different drawings, and the duplicate explanation thereof will be omitted.

In the case where it is installed to the front end of the guard rail for the road shoulder, since the lateral guard panel 60 or the wire cable 60*a* is installed at one side of the road, it is economical if one side is omitted. However, in the case where it is installed at the front end of the guard rail for the median strip, it is preferable that the lateral guard panel 60 or the wire cable 60*a* is installed at both sides.

The vehicle impact absorbing apparatus and method using the kinetic frictional force produced by dragging the surface of the rolled tube according to the present invention is merely exemplary and is not to be construed as limiting the present invention.

The invention claimed is:

1. A method for absorbing a vehicle's impact using a kinetic frictional force produced by dragging a surface of a rolled tube, the method comprising: absorbing impact energy of the vehicle primarily by a dragging action of a front barrier and a first dragging kinetic frictional force inducing member with a kinetic friction inducing bolt inserted therein, the first dragging kinetic frictional rolling force inducing member being sequentially installed on a front end portion of a kinetic frictional force inducing tube made of a soft material, with respect to the friction force inducing tube, so that a maximum deceleration of the vehicle slows to 20 g ($g=9.8$ m/sec$^2$) or less;

while dragging the front barrier and the first dragging kinetic frictional rolling force inducing member, dragging a second dragging kinetic frictional force inducing member having a kinetic friction inducing bolt inserted therein and a kinetic friction coefficient larger than that of the first dragging kinetic frictional rolling force inducing member and installed at an intermediate portion of the kinetic frictional force tube, to secondarily absorb and reduce kinetic energy; and while dragging the front barrier, the first dragging kinetic frictional rolling force inducing member and the second dragging kinetic frictional force inducing member, with the kinetic friction inducing bolts and inserted therein, dragging a rear barrier and a third dragging kinetic frictional force inducing member having a kinetic friction inducing bolt inserted therein, the rear barrier being installed at a distance S from a stopper installed rearward on the tube, so that a kinetic frictional force of the vehicle becomes a maximum stop frictional force in a state in which kinetic friction coefficients of the first dragging kinetic frictional force inducing member and the second and third dragging kinetic frictional force inducing members all increase.

2. The method according to claim 1, wherein the kinetic friction inducing bolts are made of a hard material, and the kinetic friction force inducing tube is made of a soft material, wherein a surface and corner portion of the kinetic friction force inducing tube is not torn, but is made concave by dragging action of the kinetic friction inducing bolts so that the surface is thinly rolled and cut to continuously absorb the kinetic energy.

3. The method according to claim 2, wherein a number of stopper bolts are installed to a guard rail within the distance S from the stopper in a protruding manner to absorb all the remaining kinetic energy.

4. The method according to claim 3, further comprising adjust a magnitude of kinetic friction coefficients of the surface of the kinetic friction force inducing rolled tubes, the first dragging kinetic frictional rolling force inducing member and the second and third dragging kinetic frictional rolling force inducing members and by rotation and pressurization of the kinetic friction inducing bolts.

5. An impact absorbing apparatus capable of absorbing kinetic energy of a vehicle using a kinetic frictional force produced by dragging a surface of a rolled tube, in which a barrier is supported by a guard rail via a support rail wheel, the apparatus comprising:

a kinetic friction force inducing rolled tube installed parallel to the guard rail;

a first dragging kinetic frictional force inducing member, a second dragging kinetic frictional force inducing member, and a third dragging kinetic frictional force inducing member mounted on the rolled tube; and a first dragging kinetic frictional force inducing member guide of a front barrier installed at a front end of the rolled tube and a third dragging kinetic frictional force inducing member guide of a rear barrier is installed at a rear end of the rolled tube, wherein the first dragging kinetic frictional force inducing member and the second and third dragging kinetic frictional force inducing members collectively absorb the kinetic energy when the first dragging kinetic frictional force inducing member guide is moved along the rolled tube in a direction of the third dragging kinetic frictional force inducing member guide; the first dragging kinetic frictional force inducing member installed in a front end portion of the kinetic frictional force inducing rolled tube, the second dragging kinetic frictional rolling force inducing member being installed in an intermediate portion of the rolled tube, and the third dragging kinetic frictional rolling force inducing member being installed in a rear end portion of the rolled tube;

a kinetic friction inducing bolt inserted and fastened to a kinetic friction inducing bolt vertical bolt hole of the first dragging kinetic frictional rolling force inducing member 40*a*, and a kinetic friction inducing bolt are inserted and fastened to a kinetic friction inducing bolt corner bolt holes of the second dragging kinetic frictional rolling force inducing member; and the surface dragging inducing groove and the corner dragging inducing groove are formed in a depth deeper than a surface and corner of the kinetic frictional force inducing rolled tube at positions in which the kinetic friction inducing bolts of the first dragging kinetic frictional rolling force inducing member and the second and third dragging kinetic frictional rolling force inducing members correspond to the kinetic frictional force inducing rolled tube.

6. The impact absorbing apparatus according to claim 5, further comprising a fastening plate provided with a fixing hole and a fastening hole, and a support bracket having a coupling fixing plate provided with a fixing bolt hole, wherein the fixing hole of the fixing plate corresponds to the fixing bolt hole of the support bracket, and the fastening hole of the fastening plate corresponds to the fastening hole of the kinetic frictional force inducing rolled tube, in which a fixing bolt is fastened to the fixing bolt hole, and a fastening bolt is fastened to the fastening hole of the fastening plate.

7. The impact absorbing apparatus according to claim 5, further comprising a stopper bolt protruding through a stopper bolt hole, which is punched in a flange of the guard rail, within a S from a stop rearward of the tube, in which an intermediate barrier and the front and rear barriers are not installed.

8. The impact absorbing apparatus according to claim 5, wherein a magnitude of a kinetic friction coefficient of the kinetic friction force inducing rolled tube, the first dragging kinetic frictional rolling force inducing member and the second and third dragging kinetic frictional rolling force inducing members are adjustable by rotation and pressurization of the kinetic friction inducing bolts.

9. The impact absorbing apparatus according to claim 5, wherein a stopper is installed at an end of the guard rail, at which the stopper distance S is zero, and is supported by the fixing plate and the support bracket.

10. The impact absorbing apparatus according to claim 5, wherein the number of the first dragging kinetic frictional rolling force inducing members and the second and third dragging kinetic frictional rolling force inducing members which are inserted into the kinetic frictional force inducing rolled tube is selected depending upon a magnitude of the impact energy of the vehicle.

11. An impact absorbing apparatus capable of absorbing kinetic energy of a vehicle using a kinetic frictional force produced by dragging a surface of a rolled tube, in which a barrier is supported by a guard rail through a support rail wheel, comprising:

kinetic frictional force inducing rolled tubes, each with a surface dragging inducing groove, installed at both sides of a guard rail, and are fixed by a height adjustment support;

a plurality of dragging kinetic frictional dragging force inducing members, each with a kinetic friction inducing bolt vertical bolt hole, into which a kinetic friction inducing bolt is inserted, and mounted on one of the kinetic frictional force inducing rolled tubes;

each of the dragging kinetic frictional rolling force inducing members being slidable horizontally along the respective kinetic frictional force inducing rolled tube;

each of a dragging kinetic frictional rolling force inducing members being welded and fixed to a support rail wheel;

the height adjustment support being welded and fixed to a lower portion of the dragging kinetic frictional rolling force inducing member, and a lower end portion of the height adjustment support being welded and fixed to a fixing plate;

a barrier is vertically welded and fixed to the support rail wheel, and the kinetic friction inducing bolt being inserted into the kinetic friction inducing bolt hole of the dragging kinetic frictional rolling force inducing member and presses and rolls a surface of the kinetic frictional force inducing rolled tube to continuously absorb the kinetic energy.

12. The impact absorbing apparatus according to claim 11, wherein a wire cable support is fixed to the side of the barrier, and the wire cable support is installed in parallel with the wire cable in a longitudinal direction.

* * * * *